United States Patent [19]

Galphin

[11] Patent Number: 5,011,161

[45] Date of Patent: Apr. 30, 1991

[54] WATER AMUSEMENT GAME

[76] Inventor: Marion C. Galphin, P.O. Box 34, Ninety-Six, S.C. 29666

[21] Appl. No.: 412,011

[22] Filed: Sep. 25, 1989

[51] Int. Cl.[5] ..... A63B 71/02; A63H 23/00

[52] U.S. Cl. ..... 273/349

[58] Field of Search ..... 273/349

[56] References Cited

U.S. PATENT DOCUMENTS

| | | | |
|---|---|---|---|
| 3,843,127 | 10/1974 | Lack | 273/349 |
| 4,040,622 | 8/1977 | Sinnott | 273/349 X |
| 4,128,966 | 12/1978 | Spector | 273/349 X |
| 4,165,073 | 8/1979 | Kellerstrass' | 273/349 |
| 4,412,680 | 11/1983 | Zorn | 273/349 X |

*Primary Examiner*—William H. Grieb
*Attorney, Agent, or Firm*—Cort Flint

[57] ABSTRACT

A water amusement game is disclosed which includes a pad (11) having opposed player stations (10, 12) arranged at the opposite ends of the pad which includes submarine replicas (A, B). Water cannons (24) are aimed at a movable target (C) in accordance with the skill of the players at each station. As target (C) is advanced toward a losing station by the players at the opposite station, sensor (E) senses movement of the target toward the moving station. Sensor (E) comprises a plurality of electrical switches (28, 30, 32 and 34, 36, 38). In response to the detection of the target moving toward a losing station, prescribed quantities of water are dispensed by various water dispensing elements (64, 66, 68) to progressively apply larger amounts of water toward the face of the losing players. This impairs the ability of the losing players to reverse the movement of the target. As the target moves past the last switch, the door to the submarine is locked, a drenching amount of water is dumped on the players along with the emission of audible signals (70, 72) saying that the submarine is taking on major water and sinking.

30 Claims, 3 Drawing Sheets

WATER AMUSEMENT GAME

BACKGROUND OF THE INVENTION

The invention relates to a water amusement game of the type to be played at a major water amusement park.

Following the advent of major amusement ride parks, there has been an increase in the development of amusement parks which have as their major theme, water rides and games. Particularly in the coastal and warmer climate areas, amusement parks have been developed consisting of inner tube rides, long torturous water slides, wave pools, and floating rivers where persons dressed in bathing suits participate in the water rides for an admission price. With the increasing popularity of amusement parks having a water theme, there has become a need for more diverse and varied water rides and games which can be offered. Particularly, this is true for water amusement games which are a major attraction.

Heretofore, U.S. Pat. No. 3,843,127 has taught a water gun wherein oppositely positioned players shoot at a target in which the more accurate player is rewarded by causing the target to turn in the direction of the opponent to discharge water on him. U.S. Pat. No. 4,165,073 discloses a target slidably carried on a cable with opposing players holding water guns to move the target with the object being to move the target to the opposing end of the target. These games are relatively simple and offer very little challenge to the players in the way of skill or consequences.

Accordingly, an important object of the invention is to provide a water amusement game for use as a major attraction at a water amusement park and the like which involves sufficient skill and consequences to present substantial challenge to the players.

Another object of the invention is to provide a water amusement game which can be played by persons dressed in bathing suits but will allow the players not to become wet should they play the game with sufficient skill.

Another object of the invention is to provide a water amusement game by which bathing suit dressed players at opposing stations are provided with operator controls which determine the movement of a moving target in such a manner that the persons which are able to move the target towards the opposite station which cause increasing amounts of water to be dispensed at the players at the opposite station as the target moves increasingly closer to the opposite station.

Another object of the invention is to provide a water amusement game in which bathing suit dressed players are enclosed and contained in opposed housings from where they manipulate a device to cause movement of a sliding target wherein varied amounts of water are dispensed, and alarm and voice signals are emitted at the housings as the target is moved toward one housing with the final consequence being locking of the doors of the housing and drenching of the players with water.

Another object of the invention is to provide a water amusement game which is fully automatic and involves bathing suit dressed players at opposite stations with automatic control of water being dispensed at the opposite stations depending upon the skill of the players at the respective stations.

SUMMARY OF THE INVENTION

The above objectives are accomplished according to the present invention by providing first and second spaced stations at which bathing suit dressed players are generally confined with an operator device for controlling the movement of a target which slides in a straight line between the stations. Manipulation of the operator device in accordance with the skill of the players causes the target to move either in a first direction toward the first station or in a second direction toward the second station. Sensor means detects movement of the target in the first and second directions. A control system is provided which dispenses varying amounts of water at the first and second stations depending upon signals received by the sensor. For example, when sensing movement of the target to a first position in the second direction, a fine spray of water will be sprayed on the players at the second station. Should the target continue to be moved toward the second station by manipulating the operator device at the first station, its presence is sensed at a second position by the sensor, and a shower of water will be sprayed on the players. Upon further movement of the target to a third position towards the second station, the operator device of the players at the second station will be terminated, and water will be poured on the players which the players being prevented from leaving the second station. Timed control of the game may be had so that if the target is not moved to the first position of either station within a prescribed time, the spray of water will be applied to players at both stations. If position two is not reached toward either target within a second prescribed time, the shower will be cut on at both stations. If position three is not reached within a third prescribed time, water will be poured on the players at both stations. In addition, it is preferred that a replica of a submarine or other vessel be arranged at the first and second stations in which the players are retained during the game. In this case, the operator for causing the target to move is preferably a plurality of water jet cannons at each submarine replica controlled by the players at the respective stations. In addition to the increasing application of water at the losing submarine, audible signals including sirens and alarms will go off as increasing water is applied to indicate that submarine has suffered a direct hit, major damage and is taking on the increasing amounts of water.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, a water amusement game is illustrated which includes a first player station designated generally at 10 and a second player station designated generally at 12 which are spaced from one another generally along a straight line. Means for confining the players at the first and second stations are provided in the form of a submarine replica A and B at stations 10 and 12 respectively. It is to be understood, of course, that other means for confining the players at the first and second stations may be provided so that they do not escape the penalties of increasing applications of water at the losing station. While submarine replicas are shown, other vessels may be used. Even means for confining the players which does not completely enclose the players may be used.

Figure 1:
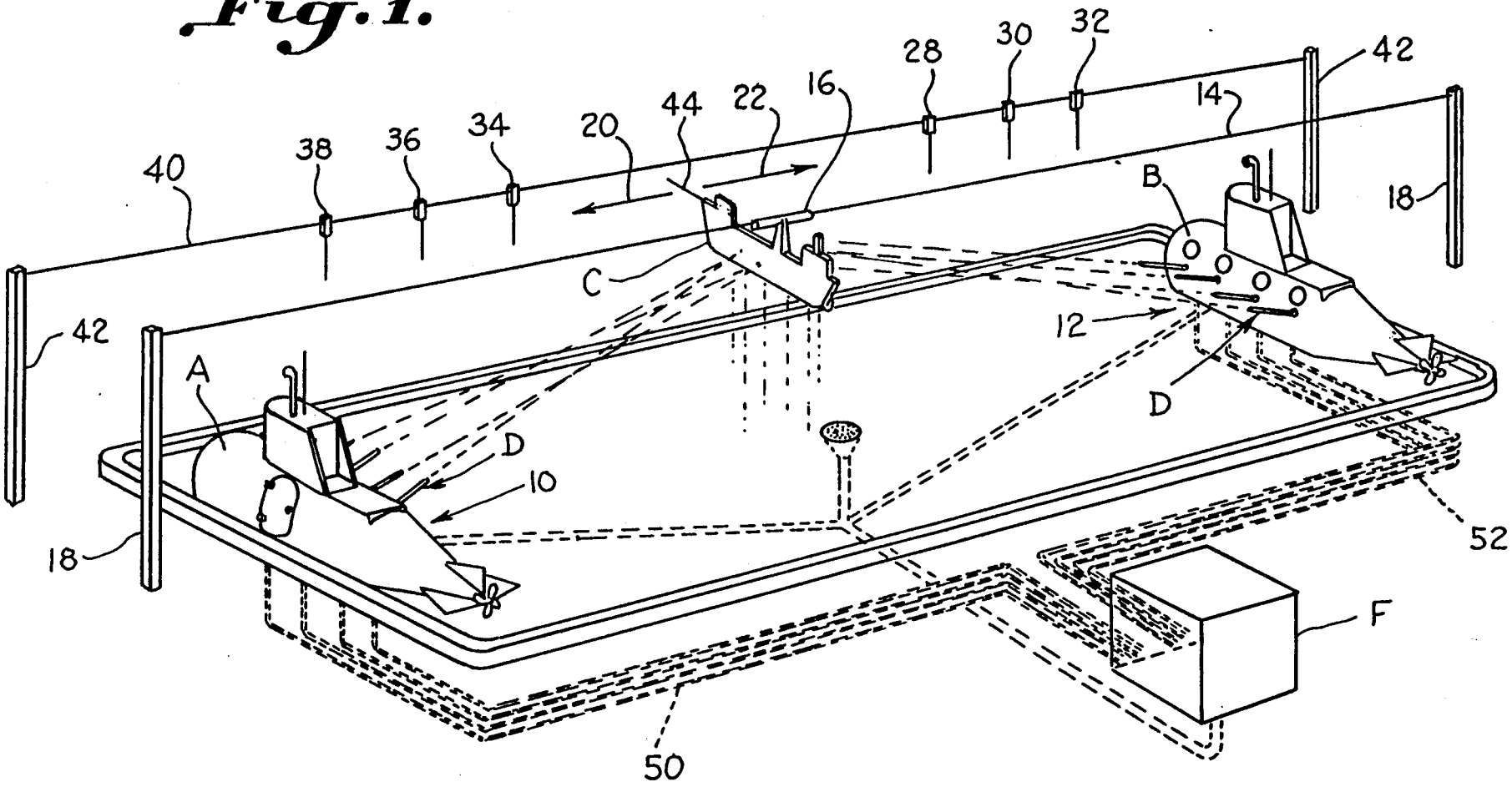
FIG. 1 is a perspective view illustrating a water amusement game constructed in accordance with the present invention.
Figure 2:
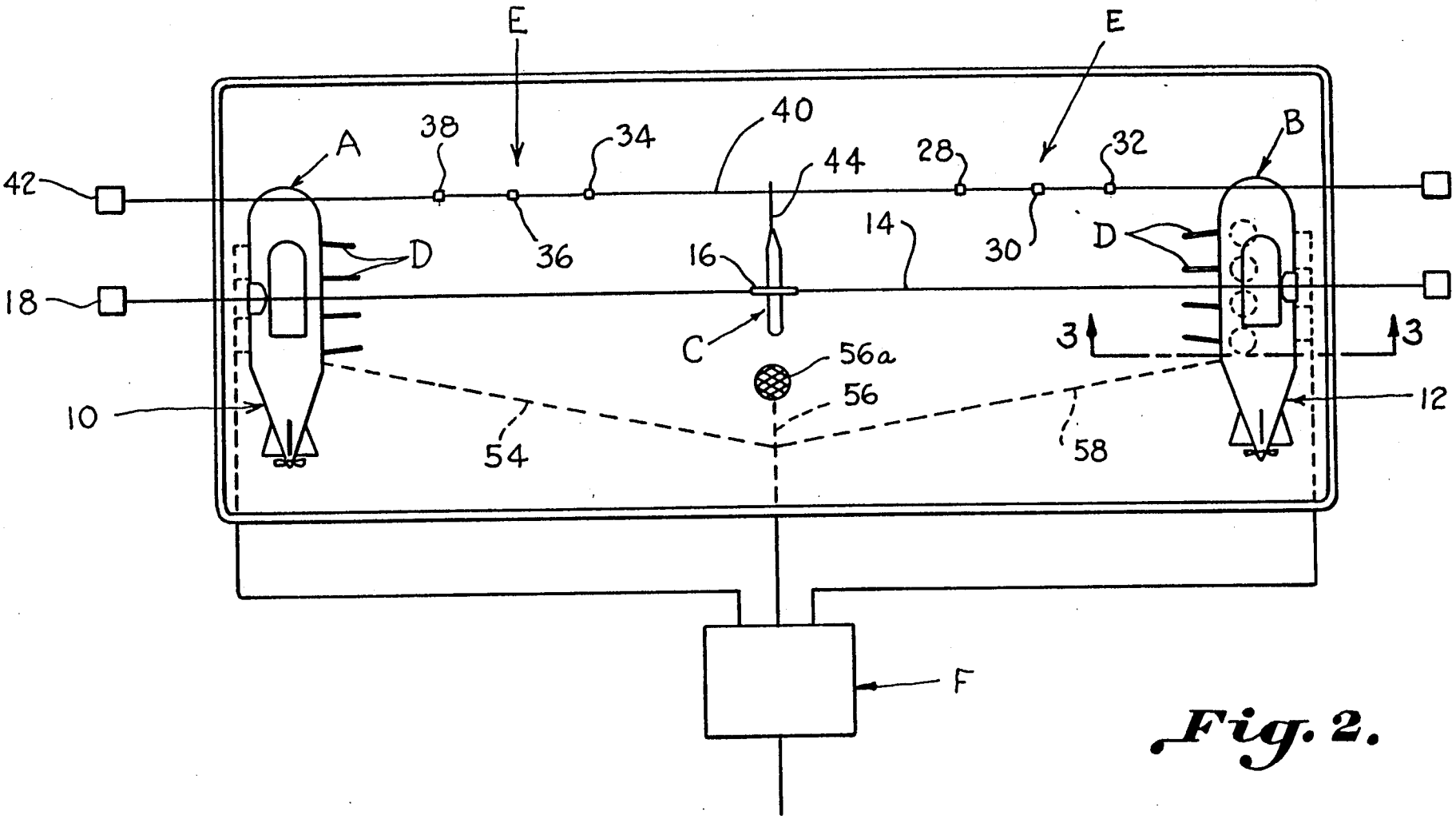
FIG. 2 is a top plan view of a water amusement game constructed in accordance with the present invention.

A cable 14 is carried generally in a straight line between player stations 10 and 12 on which a moving target C slides between submarines A and B. A sleeve 16 carried by target C is slidably received on cable 14. Cable 14 is suspended by a pair of standards 18. As can best be seen in FIG. 1, target C is preferably in the shape of a ship. Operator means D is provided at each player station which are manipulated according to the skill of the players causing the target to move either in a first direction 20 toward first station 10 or in a second direction 22 toward second station 12. While the operator means may be any suitable means for causing the target to move in response to the skill of manipulation of the players, i.e. electronic game at each player station, it is preferred that the operator means is a pivotal water jet cannon 24 for each player at each station. The water game may even be played with a single player at a single station without departing from the spirit of the invention. While the water user game according to the invention may be played with as little as one player at each station, it is contemplated that several players will be confined at each station in the preferred embodiment of the game. Each water cannon 24 emits a water jet 26. As illustrated, there are four water cannons at each station within each submarine. Target C will move most readily in the first or second direction by impingement of the water jets from the opposite station near the center of the target. Whichever players are able to manipulate the water cannons in this manner will succeed in moving target C toward the opposite station.

Sensor means E for sensing movement of the target in either direction are provided. Preferably, sensor means E includes an electrical switch 28 at a first position, an electrical switch 30 at a second position, and an electrical switch 32 at a third position toward second player station 12 in second direction 22. Additionally, there is an electrical switch 34 at a first position, an electrical switch 36 at a second position, and an electrical switch 38 at a third position, in first direction 20 toward first player station 10. These switches may be affixed to a generally rigid cable or rod 40 stretched between a pair of standards 42. The electrical switches are carried in a path of an actuator arm I0 44 carried by target C so that arm 44 will actuate the switches as it is moved in either direction. Electric eyes, or other noncontacting sensors may be used.

Figure 4:
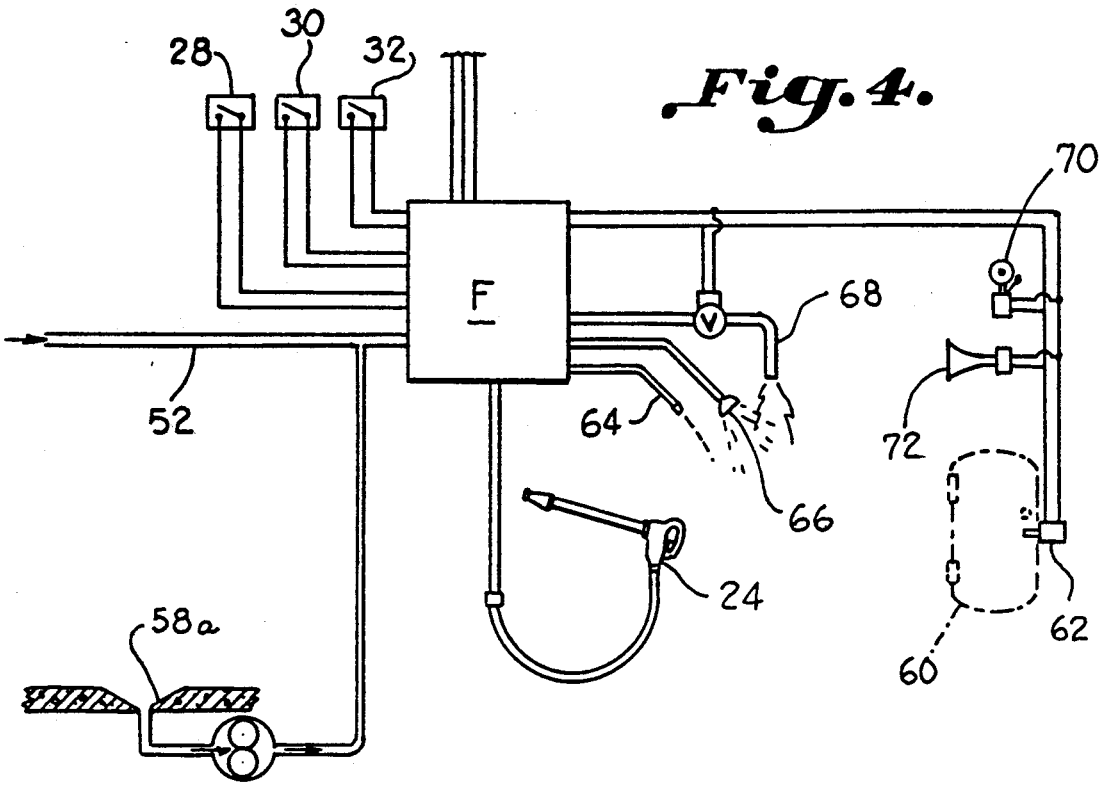
FIG. 4 is a schematic view of a control system for use in dispensing water and emitting audible alarm signals for a water amusement game in connection with the present invention.
Figure 3:
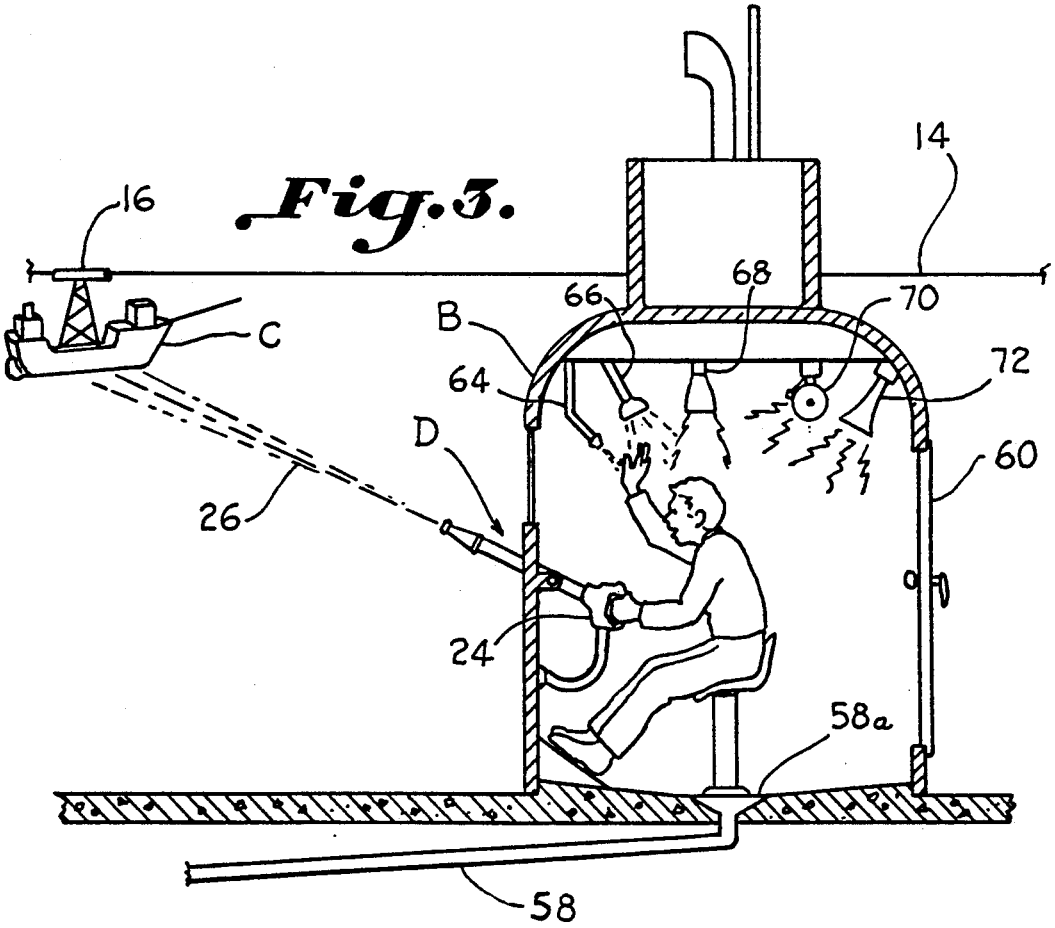
FIG. 3 is a sectional view of a submarine replica employed with a water amusement game in accordance with the present invention.

Control means F is provided for controlling the water circuits necessary to carry out the amusement game and the electrical circuits for the game. Water lines 50 deliver water to water cannons 24 at first player station 10 and water lines 52 carry water to water cannons 24 at second player station 12. Water drain lines 54, 56, 58 return water from submarine A, drain **56*a* of the pad, and submarine B. This water may be suitably filtered and recirculated for use in the game. Signals from the sensor switches 28, 30, 32 and 34, 36, 38 are also transmitted to control means F. Referring to FIG. 4, the control system will now be described in reference to second player station 10 and electrical switches 28, 30, 32. Since the set-up of each player station is essentially the same, and submarines A and B are identical, only one station will be described for purposes of an understanding of the invention. As can best be seen in FIG. 3, submarine B includes an enclosure having a door 60 which may be locked by a lock 62 controlled by control means F. Inside submarine B is a first water dispensing means 64 for dispensing a fine spray of water on player P. A second water dispensing means includes a shower head 66 which dispenses a shower of water on player P which is more and heavier than the water applied by dispensing means 64. A third water dispensing means 68 is provided over player P which pours large quantities of water on player P, larger than the previous quantities applied. It will be noted that first and second water dispensing means 64 and 66 are disposed generally in front and overhead of player P so that water dispensed from these means will be applied in the front face area of the player P to interfere with his ability to aim his water cannon. An alarm means 70 is provided which may be a bell or a siren alarm. A speaker 72 is provided for receiving audible voice transmissions from the captain of the submarine. This can be pre-recorded or live. A drain 58*a*** is included in the floor of the submarine for returning the water applied to the players.

The operation of the water amusement game will now be described in a sequence where target C is moved toward second station 12 by the players in submarine A without reversal of the movement of target C which, of course, is very much a possibility. As the players in submarine A are able to skillfully direct the water jets from water cannons 24 toward the center of target C, it moves in the direction 22. At the first position, electrical switch **28*a* is actuated by arm 44 of target C. This causes water dispensing means 64 to be turned on and a fine spray of water to be sprayed into the face of players P in submarine B. Speaker 72 may come on announcing that submarine A has encountered a direct hit. Of course, the water from spray head 64 will make it hard for players P to reverse the move of target C. If the players in submarine B should be able to move target C back past switch 28, then the water would be cut off. However, should the players in submarine A continue to move target C past the second position and switch 30, second water dispensing means 66 will also be cut on dispensing a shower of water in the face of players P. Alarm 70 will then go off and the captain voice will come on over the speaker saying that major damage has been done to the submarine and it is taking on water. The shower of water from 66 will make it even more difficult for the players in submarine B to hit target C and move it back in the opposite direction. Finally, should players in submarine A continue to move target C towards submarine B, switch 32 will be actuated at the third position. This will cause water to pour from water dispensing means 68 directly on top of all of the players in submarine B. At the same time, lock 62 will be energized making it impossible for players in submarine B to flee. Water cannons 24** associated with submarine B will be cut off so that players in submarine B will no longer be able to try to reverse the direction of target C and a complete soaking of players P will be had for a prescribed period of time.

If players P in submarine B are able to move target C in a reverse direction past switch 30 prior to switch 32 being actuated, water dispensing means 66 will be cut off as previously described in reference to water dispensing means 64. In accordance with the present invention, control means F is also provided to accommodate the situation in which neither player may be able to move target C past the first position in either direction 20 or 22. In this case, a control system is provided so that if neither switch 28 or 34 is hit within a prescribed time such as two minutes, water dispensing means 64 at both submarines A and B will be cut on. If neither switch 30 or 36 is actuated within a second prescribed time such as four minutes, the shower 66 is turned on at both submarines A and B. If neither switch 32 or 38 is turned on within a third prescribed time such as six minutes, water is dumped on all of the players in both submarines. Provisions for a suitable control means for carrying out the game as described is well within the purview of one having average skill of the automatic control art. Of course, any variations of the control means may be had to provide different penalties and consequences of not being able to successfully move the target.

While the game object has been described as moving a target towards an opposing player station, it is also contemplated that a different game object may be used in accordance with the invention, for example, any game of skill in which the achievement of game object conditions can be achieved by a player and detected by a sensor, such as an electronic game.

Thus, it can be seen that a attractive and advantageous water amusement game can be had in accordance with the present invention whereby players dressed in bathing suits may be confined at opposite player stations and suffer increasing applications of water depending upon their skill or lack of skill in fighting the game.

While a preferred embodiment of the invention has been described using specific terms, such description is for illustrative purposes only, and it is to be understood that changes and variations may be made without departing from the spirit or scope of the following claims.

What is claimed is:

1. A water amusement game comprising:

a first player station at which at least a first player is stationed, a second player station at which at least a second player is stationed, and said first and second stations being spaced from one another;

at least one water cannon at each of said first and second stations operable by said players, said water cannons emitting a water jet which impinges upon said target in response I0 to the operation of said water cannons by said players in accordance with the manipulation and skill of said players;

a target;

sensing means for detecting a condition of said target in response to the impingement of said water jet on said target;

water dispensing means for dispensing water on said players at said first and second stations; and control means for activating said water dispensing means in response to signals received from said sensor means in response to said detection of said target condition to dispense water at said first and second stations in accordance with the skill of said players at said first and second stations to accurately hit said target with said water jet.

2. The device of claim 1 wherein said water dispensing means includes a plurality of water dispensing means which dispense progressively different quantities of water on said players, said target being carried for movement generally towards and away from said first and second stations, said sensor means detecting movement of said target to a plurality of positions toward said first and second player positions, and said control means activating said plurality of water dispensing means sequentially with the detection of said target at said prescribed positions to dispense said different quantities of water on said players.

3. The device of claim 2 wherein said plurality of water dispensing means includes a first water dispensing means which applies a fine spray of water, second water dispensing means which applies a coarser shower of water, and a third water dispensing means which dumps a large supply of water on said player.

4. The device of claim 3 wherein at least said first water dispensing means is arranged to apply at least said fine spray of water toward the face of said player to effectively interfere with the manipulation of said operator means by said player.

5. The device of claim 2 including an audible signal means for producing audible signals in response to said sensor means detecting movement of said target along said prescribed positions.

6. The device of claim 5 wherein said audible signal means includes an audible alarm signal and an audible voice signal.

7. The device of claim 1 including an audible signal means for producing audible signals in response to said sensor means detecting said target condition.

8. The device of claim 2 including means for confining said player toward which said target is moved at said station for preventing said player from escaping as larger quantities of water are dispensed on said player.

9. The device of claim 1 including a substantial enclosure in which said players are confined at said first and second player stations, a door for entering said enclosure, and means for locking said door for preventing escape of said player under prescribed conditions.

10. The device of claim 9 wherein said enclosure is constructed as a replica of a marine vessel.

11. The device of claim 1 including means for supporting said target for movement, and said sensor means senses the movement of said target.

12. The device of claim 11 including means for disabling said water cannon of said player toward which said target is moved upon said target reaching a prescribed position.

13. The device of claim 11 wherein said sensor means includes a plurality of electrical switches carried at prescribed positions along the path of movement of said target movement, and an actuator arm carried by said target for actuating said switches in series as said target moves toward either of said first and second player stations.

14. A water amusement game comprising:

a first player station at which at least a first player is stationed and a second player station at which at least a second player is stationed, said first and second stations being spaced from one another generally along a straight line;

a movable target;

operator means operated by said players at said first and second stations for causing said target to move in response to manipulation of said operator means by said players;

sensor means for detecting movement of said movable target;

water dispensing means for dispensing water on said player at said first station and on said player at said second station; and control means for activating said water dispensing means in response to movement of said target in said first and second directions as detected by said sensor means to dispense water at said respective second and first stations so that water is dispensed on the player at the station toward which said target is moving.

15. The device of claim 14 wherein said water dispensing means includes a plurality of water dispensing means which dispense progressively different quantities of water on said players, said sensor means detecting movement of said target to a plurality of positions toward said first and second player positions, and said control means activating said plurality of water dispensing means in series with the detection of said target at said prescribed positions.

16. The device of claim 14 wherein said plurality of water dispensing means includes a first water dispensing means which applies a fine spray of water, second water dispensing means which applies a coarser shower of water, and a third water dispensing means which dumps a large supply of water on said player.

17. The device of claim 16 wherein at least one of said water dispensing means is arranged to apply said fine spray of water to the face of said player to effectively interfere with the manipulation of said operator means by said player.

18. The device of claim 15 including an audible signal means for producing audible signals in response to said sensor means detecting movement of said target to said prescribed positions.

19. The device of claim 18 wherein said audible signal means includes an audible alarm signal and an audible voice signal.

20. The device of claim 14 including an audible signal means for producing audible signals in response to said sensor means detecting movement of said target to said prescribed positions.

21. The device of claim 15 including means for confining said player toward which said target is moved at said station for preventing said player from escaping as water is dispensed on said player.

22. The device of claim 14 including means for disabling said operator means of said player toward which said target is moved upon said target reaching a prescribed position.

23. The device of claim 14 including a substantial enclosure in which said players are confined at said first and second player stations, a door for entering said enclosure, and means for locking said door for preventing escape of said player under prescribed conditions.

24. The device of claim 23 wherein said enclosure is constructed as a replica of a marine vessel.

25. The device of claim 14 wherein said sensor means includes a plurality of electrical switches carried at prescribed positions along the path of movement of said target movement, and an actuator arm carried by said target for actuating said switches in series as said target moves toward either of said first and second player stations.

26. A water amusement game comprising:

first and second player stations at which at least first and second players are stationed for playing the amusement game wherein said first and second stations are spaced from one another;

a movable target carried for movement generally along a path parallel to a line between said first and second stations;

sensor movement for detecting the movement of said movable target along said path;

a plurality of water cannons pivotally carried at said first and second stations in a manner that they may be aimed at said target for impinging a water jet upon said target to cause said target to move in response to the skill of the players and manipulation of the water cannon;

a water dispensing means disposed at said players' stations for dispensing prescribed quantities of water on said players at a losing station in response to the superior skills of players at an opposing winning station in causing said target to move toward the losing station;

means generally confining said players at said first and second stations to prevent said players from leaving a losing station and escaping the water penalties at said station; and control means for activating said water dispensing means sequentially in response to said movement of said target as detected by said sensor means in a direction toward said losing station so that increasing amounts of water are dispensed on said players at said losing station as said target is moved progressively closer to said station.

27. A water amusement game comprising:

station means at which at least one player is stationed;

a game object to be achieved by said player;

operator means at said station means for obtaining a desired condition in response to the skill and manipulation of said operator means by said player;

water dispensing means for dispensing water on said player at said station means; and sensor and control means for sensing whether said player is achieving said game object according to prescribed conditions and for controlling said dispensing means to dispense water on said player in accordance with the achievement of said conditions.

28. The device of claim 14 wherein said water dispensing means includes means for dispensing progressively different quantities of water on said players, said sensor means detecting a plurality of said prescribed conditions, and said control means activating said water dispensing means sequentially in response to said sensor means according to the achievement of said game object by said player.

29. The device of claim 14 wherein said water dispensing means are constructed and arranged to progressively impair the ability of said player to achieve the game object.

30. The device of claim 14 including means for confining said player at said station means in response to the failure of said player to achieve a prescribed condition of said game object to prevent said player from escaping said station means and said dispensing of water.

* * * * *